United States Patent [19]

Perigo et al.

[11] 4,424,659

[45] Jan. 10, 1984

[54] METHOD AND APPARATUS FOR PRODUCING A STERILIZABLE PACKAGE OF A PRODUCT, AND THE PACKAGED PRODUCT

[75] Inventors: John A. Perigo, Hailey, Nr. Witney; John E. Divall, Purton, both of England

[73] Assignee: Metal Box Limited, Reading, England

[21] Appl. No.: 224,885

[22] Filed: Jan. 14, 1981

[30] Foreign Application Priority Data

Jan. 16, 1980 [GB] United Kingdom ..... 8001407

[51] Int. Cl.[3] ..... B65B 55/02

[52] U.S. Cl. ..... 53/425; 53/405; 53/436; 53/526; 53/527; 426/129; 426/396

[58] Field of Search ..... 53/526, 405, 408, 436, 53/425, 527, 523; 206/524.8, 525, 438, 440; 426/396, 410, 129

[56] References Cited

U.S. PATENT DOCUMENTS

| | | | |
|---|---|---|---|
| 2,811,818 | 11/1957 | McCarty | 53/427 X |
| 3,010,263 | 11/1961 | Carew et al. | 53/526 X |
| 3,117,873 | 1/1964 | Bartels et al. | 53/436 X |
| 3,517,475 | 6/1970 | Balocca | 53/526 X |
| 3,659,393 | 5/1972 | Richter | 426/396 X |
| 3,792,181 | 2/1974 | Mahaffy et al. | 426/123 |
| 4,098,404 | 7/1978 | Markert | 206/524.8 X |
| 4,223,512 | 9/1980 | Buchner | 53/425 |
| 4,287,702 | 9/1981 | Corbic | 53/425 |

FOREIGN PATENT DOCUMENTS 1131629 10/1968 United Kingdom .

*Primary Examiner*—James F. Coan

*Attorney, Agent, or Firm*—Diller, Ramik & Wight

[57] ABSTRACT

A method of producing a package of a product, which product does not include a significant amount of gas, comprising taking a shape-retaining container having a charging opening, charging the container with the product to a level which leaves a substantial headspace and, in any suitable order, (a) completely sealing the opening with a closure of stretchable material, and (b) deforming the closure inwardly onto the product to reduce the headspace and continuing the deformation, to move product adjacent the closure into the remaining headspace, until the headspace is eliminated by the continued movement of product and closure, the method being such as to form a package which is substantially gas free and substantially hydraulically solid.

29 Claims, 8 Drawing Figures

101
54
57
10
100
51
55
56
59
58
60
64
52
61
63
50
13
65
62
16
18
15

METHOD AND APPARATUS FOR PRODUCING A STERILIZABLE PACKAGE OF A PRODUCT, AND THE PACKAGED PRODUCT

FIELD OF THE INVENTION

This invention relates to the packaging of certain types of products and has particular application in packaging products which require heat-sterilisation after packaging.

BACKGROUND OF THE INVENTION

In order to avoid contaminating the heat-seal surface of rigid and semi-rigid container bodies to be closed by a heat-seal diaphragm it is known to leave a "headspace" by which the surface level of the product falls short of the heat-seal surface.

A web of flexible material is then heat-sealed to the heat-seal surface to form a generally plane diaphragm closure, after which the diaphragm is severed around the container to separate it from the parent web material.

Because of the headspace which has been provided, such prior processes have left substantial residual air trapped within the container between the diaphragm and the product. This air has caused spoilage of oxygen-sensitive products and has hindered the exploitation of sterilizable containers closed by a heat-sealed diaphragm because of the difficulty of retorting the containers with a sufficient accuracy of pressure control to ensure that the heat-seals are not ruptured or the containers otherwise deformed or damaged, by the expansion or contraction of the included air during heating and cooling. Substitution of an inert gas in the headspace has relieved the problem of oxygen spoilage but not the heat-sterilisation problem.

SUMMARY OF THE INVENTION

An object of the present invention is to provide a method of producing a package of a product, which does not need to rely upon close external pressure control and physical strength of the package material to avoid deformation or damage during heat sterilisation.

From a first aspect the invention provides a method of producing a package of a product, which product does not include a significant amount of gas, comprising taking a shape-retaining container having a charging opening, charging the container with the product to a level which leaves a substantial headspace and, in any suitable order, (a) completely sealing the opening with a closure of stretchable material, and (b) deforming the closure inwardly onto the product to reduce the headspace and continuing the deformation, to move product adjacent the closure into the remaining headspace, until the headspace is eliminated by the continued movement of product and closure, the method being such as to form a package which is substantially gas free and substantially hydraulically solid.

The product may be a liquid product, a product which though not truly liquid is sufficiently mobile to move or flow to eliminate the headspace, or a product which though containing solid which does not flow, or which it is desired not to damage by deformation, also has sufficient (which need not be a large quantity) liquid present adjacent the headspace for the liquid to provide the headspace filling function. In any event, the product should not have substantial gas inclusions.

The package retains the advantage that the seal surface will not be contaminated during and after charging, because a headspace is left. However, subject to suitable choice of materials, it can be heat-sterilised under relatively uncontrolled pressure conditions because it is ideally gas-free and so problems due to gas expansion and contraction should not arise.

In practice, absolute absence of gas will be difficult to achieve and therefore it is preferred to heat-sterilise the package under a pressure sufficient to counter gas expansion and internal development of steam. This pressure need not be carefully selected or controlled provided it is higher than the internal pressure generated in the container during processing, because the hydraulic solidity of the package, achieved by the product selection and method of package production, means that the closure and container are not susceptible to damage by external pressure even when softened by heat, unlike prior sterilisable packages. The hydraulic solidity of the package also enables the container to be made thinner than hitherto, because it does not have to resist outside pressure by its physical strength.

The hydraulic solidity of the package also gives it considerable resistance to damage in handling and transport, so the method of the invention offers advantages even when heat-sterilisation of the package is not required.

The closure deformation may be effected mechanically and/or by fluid (e.g. gas) pressure exerted on the closure. It may be effected in any desired time relation to the attachment of the closure and the closing of the opening, which operations may themselves be achieved simultaneously or otherwise.

According to the invention from a second aspect there is provided an apparatus for performing the above method, the apparatus comprising means for charging the container with the product, means for substantially eliminating permanent gas from the headspace, means for completely sealing the opening with the closure, and means for applying to the outside of the closure a deforming force substantially greater than that which would be applied by atmospheric pressure alone, to achieve said deformation.

In the described embodiment of the invention the closure has the form of a diaphragm of stretchable and heat-sealable material which is heat-sealed around the container body opening. For this and other applications the apparatus may advantageously further include an enclosure for a said container and within which a largely reduced gas pressure may be created in communication with the container headspace for the deformation of the closure, and pressure reducing means for creating the largely reduced gas pressure in the enclosure with the container therein.

From a further aspect the invention provides a package of a product, comprising a shape-retaining container charged with a product which does not include a significant amount of gas, the container having a charging opening which is completely sealed by a closure of stretchable material which is deformed inwardly into the charging opening, the package interior having no headspace and the package being substantially gas free and substantially hydraulically solid.

From yet another aspect, there is provided a method of closing an opening of a shape-retaining container containing only sufficient product to leave a substantial headspace, comprising, in any suitable order, substantially eliminating permanent gas from the headspace, completely sealing the opening with a closure which is permanently stretchable into the opening only by application across it of a force differential greater than that which would be provided by atmosphere and vacuum on its opposite sides, and applying to the outside of the closure a force substantially greater than that applicable by atmospheric pressure to permanently deform the closure inwardly into intimate contact with the product.

BRIEF DESCRIPTION OF THE DRAWINGS

A method and apparatus in accordance with the invention will now be described, by way of example, with reference to the accompanying drawings. In the drawings.

DETAILED DESCRIPTION OF EMBODIMENT

Figure 1:
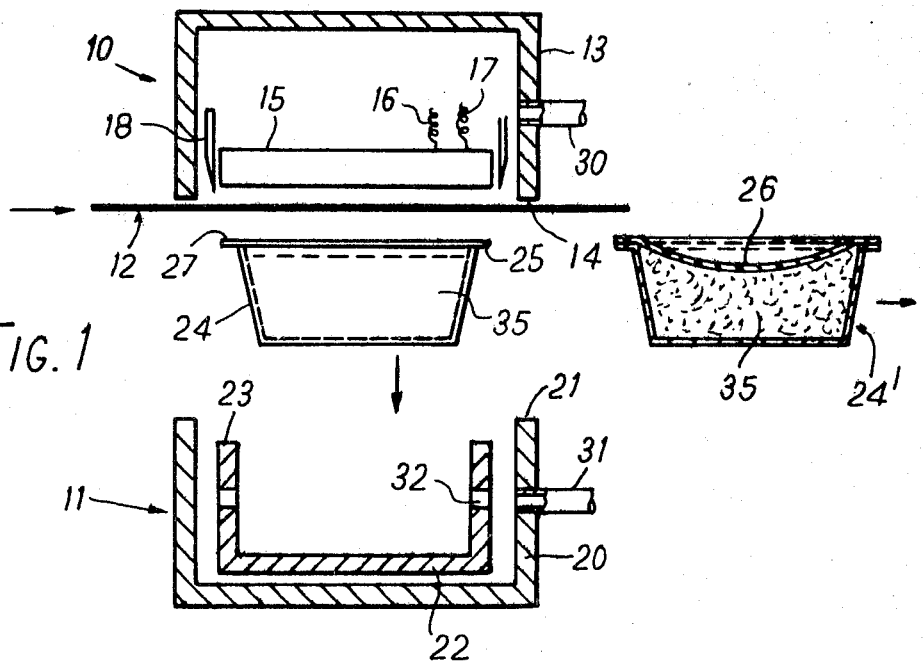
FIGS. 1 to 6 illustrate various steps in the performance of a method in accordance with the invention, and FIGS. 7 and 8 respectively show upper and lower assemblies of an apparatus arranged for performing the method of FIGS. 1 to 6.
Figure 2:
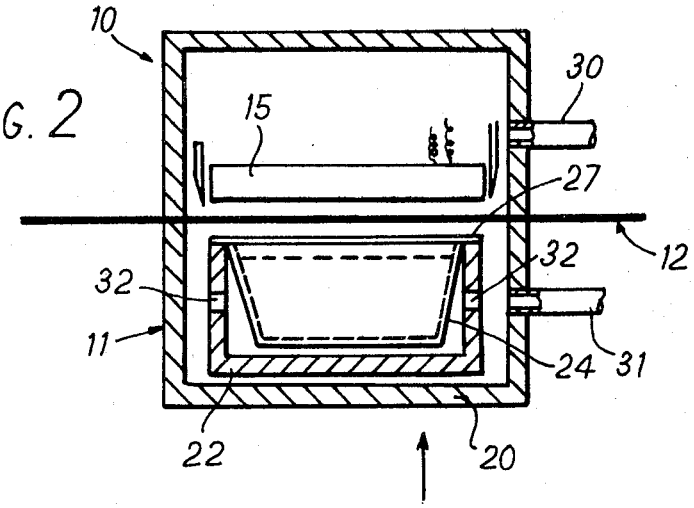

Referring now to the drawings, a vacuum sealing apparatus has upper and lower assemblies 10, 11, between which a web 12 of heat-sealable material is guided for discrete indexing movements from left to right as shown. The web is typically of aluminium foil coated on one side with polyethylene to make it heat-sealable.

The assembly 10 of the vacuum sealing apparatus comprises a cylindrical clamping member 13 in the form of an inverted cup and presenting an annular clamping face 14 at its free edge, and a heat sealing pad 15 disposed within the clamping member and moveable along the axis of the latter between retracted and advanced positions in relation to the clamping face 14. The sealing pad is continuously heated by an electric heating element (not shown) supplied through terminals 16,17.

Also provided in the assembly 10 is a cylindrical knife 18 which is located in a cylindrical clearance provided between the clamping member 13 and the sealing pad 15 and is operable after heat-sealing (as is later to be described) to sever the heat-sealed portion of the web 12 from the parent sheet.

The lower assembly 11 of the apparatus comprises a cylindrical, cup-like clamping member 20 presenting an annular clamping face 21 in opposition to the clamping face 14 of the clamping member 13 above it. The clamping faces 14,21 have the same radial dimensions and, as will shortly become apparent, are co-operable together to clamp the web 12 between them on relative approaching movement of the clamping members 13,20.

Within the clamping member 20 the lower assembly 11 of the vacuum sealing apparatus comprises a cup-like support member 22 having an upwardly facing, annular support face 23 on which a tub or pot 24 to be closed can be supported by means of its peripheral flange 25. The tub or pot 24 is conventional, having a downwardly converging body closed at the bottom, and the flange 25 which surrounds the body mouth.

The tub 24 is preferably made from a material to which the web 12 is directly heat-sealable; for example, it may be of polyethylene heat-sealable to a polyethylene coating on the web. Alternatively, it may be coated or otherwise treated to make it heat-sealable to the web. Usually the tub 24 will be of thermoplastics material.

The support member 22 is moveable within and along the lower clamping member 20 between retracted and advanced positions in relation to the clamping face 21.

By virtue of various relative movements of the upper and lower assemblies 10,11 (both in relation to one another and between their component parts) and by virtue, futhermore, of control of the gas pressures within the clamping members 13 and 20, the tub 24, charged with contents 35, is closed by a closure 26 formed from the web 12 as a diaphragm across the mouth of the tub.

As can clearly be seen from the right hand side of FIG. 1 which shows a closed tub—now denoted 24'—with its contents 25 and diaphragm closure 26, the deformation of the closure 26 has been continued so as to move or flow the product adjacent the closure into the headspace until the latter is eliminated by the combined movements.

The manner in which the diaphragm 26 is formed from the web 12 will now become apparent from the following description given specifically with reference in FIGS. 1 to 6, which depict various stages of the apparatus in operation.

In FIG. 1 the apparatus has just operated on the tub 24' which is being moved to the right for discharge from the apparatus. At this time the lower assembly 11 is in a fully lowered position, at which a sufficient clearance exists between the two assemblies to allow the tub to be removed.

After the completed tub has been replaced by a further, unclosed (but filled) tub 24 as indicated, and, moreover, the web 12 has been indexed as denoted by the arrow to bring fresh web material between the two assemblies 10, 11, the lower assembly 11 is raised to a position (FIG. 2) at which the clamping faces 14, 21 engage the web 12 so as to clamp the web between them.

The heat-sealing pad 15 and the support member 22 are at this time in their retracted positions, so that within the annular clamping region of the faces 14, 21 the web is completely free.

The individual engagement of the clamping face 21 with the web forms a seal enabling a largely reduced pressure to then be created within the clamping member 20 below the web. If desired a reduced pressure may also be created within the clamping member 13, for which the clamping face 14 forms another seal with the web 12. The pressures within the two clamping members may be equal. They are created by a vacuum pump (not shown) connected to the clamping members by conduits 30, 31. Ports 32 in the support member 22 communicate the reduced pressure in the clamping member 20 to the interior of the support member.

Figure 3:
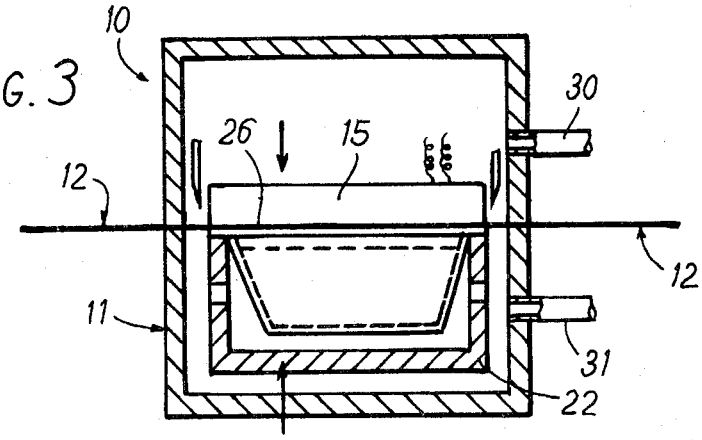
Figure 4:
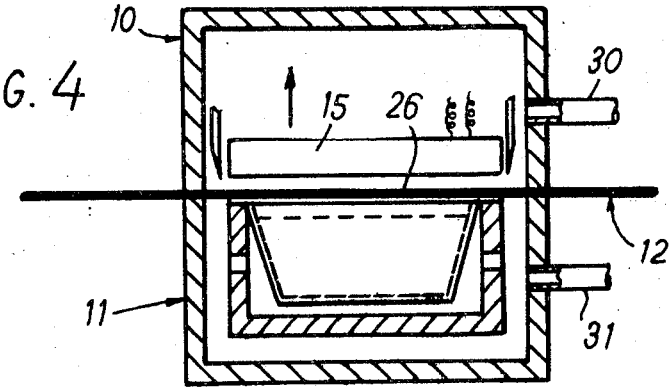

After the reduced pressure has been created in the lower assembly 11 in this way the heat sealing pad 15 and support member are advanced towards one another so as, as shown in FIG. 3, to press the flange 25 of the tub 24 against the web 12 within the clamped region of the latter. In known manner, heat from the pad and pressure generated between the pad and the support member then cause the web and flange to soften and fuse together where they are in contact so that, when (FIG. 4) the heat-sealing pad 15 is subsequently raised, a heat seal has been formed between the free upper surface 27 of the flange 25 and a heat seal region (unnumbered) of the web, and the tub has been hermetically closed by a diaphragm extending across its mouth. This diaphragm forms the diaphragm closure of the completed tub, and is accordingly denoted by the reference numeral 26 in FIG. 3 et seq. It is formed of the heat seal region around its periphery, and a free portion overlying the mouth opening within the heat seal region.

After a period of time to allow the heat seal to cool, the conduit 30 is switched from the vacuum pump to a source of substantial super-atmospheric pressure (e.g. 40 p.s.i. gauge). If desired, the conduit 31 may simultaneously be connected to atmosphere.

By virtue of the substantial differential pressure across it, the free portion of the diaphragm 26 is deformed, with stretching, into the tub 24 so as to become generally concave to the tub exterior. Because the heat seal between the web and tub was previously made (as described above) while the tub was located within a substantially reduced pressure environment, the gas pressure in the tub headspace is correspondingly low (e.g. 1 inch of water—absolute), and the diaphragm is able, as it deforms, to eventually come into engagement with the surface of the contents 35 over substantially the whole of the contents surface area. When the deformation is complete, therefore, little or no headspace exists within the tub, and the tub is hydraulically solid and correspondingly robust to withstand the loads which may subsequently be imposed upon it during storage, transit and display. Moreover, because of its lack of any substantial headspace, the tub (assuming a suitable choice of materials) is able satisfactorily to withstand processing at sterilisation temperatures without the need for careful pressure control during retorting.

Figure 5:
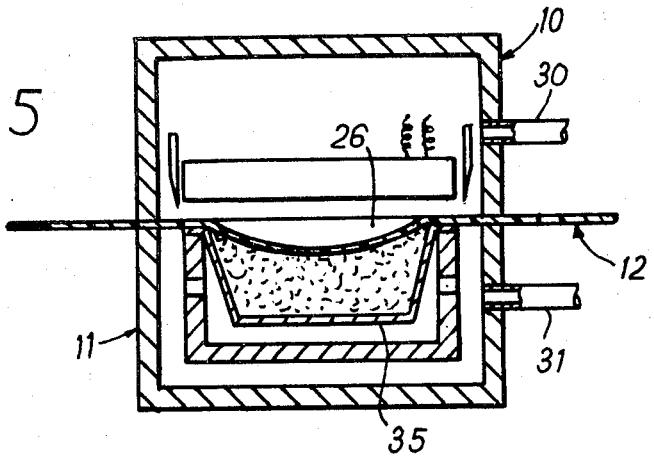
Figure 6:
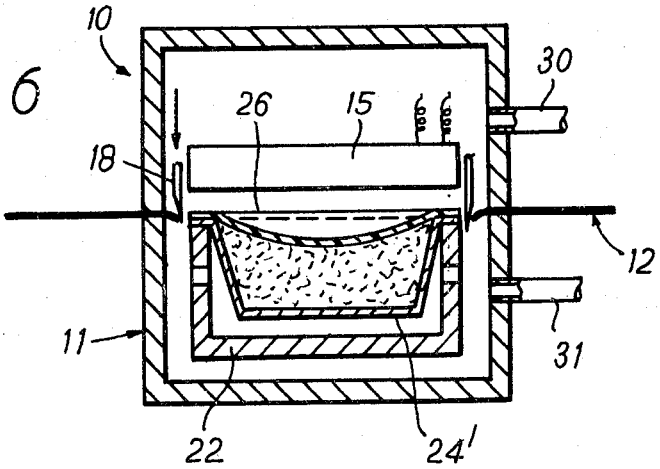

The nature of the contents 35 must enable at least a part thereof contracting the diaphragm to undergo a degree of redistribution within the tub 24 as the diaphragm moves in engagement with it, so as to substantially eliminate the headspace. As depicted in FIG. 5, homogeneous, easy-flowing contents would be naturally redistributed within the tub until the diaphragm 26 had adopted the form of a shallow parabola.

After a time sufficient to complete the deformation of the diaphragm, the knife 18 (FIG. 6) is lowered to sever the web 12 around the free edge of the tub flange 25 and so separate the tub (now denoted 24') from the web. The lower assembly 11 is then lowered, and the tub 24' is removed (manually or otherwise) and replaced by a tub 24 to be closed. The web is indexed forward, and the sequence described above is repeated for the new tub.

It will be understood that in the preferred embodiment the web 12 must be of a material which is able to undergo a substantial degree of stretching to enable it to deform into contact with the tub contents. It must furthermore be heat-sealable to the tub as previously discussed. The web may be wholly of plastics material or it may include a metal foil layer. One particular web material which we have found to be satisfactory with a polypropylene tub 24 is a laminate formed of 40μ aluminium foil with a 30μ coating of oriented polypropylene on one side. Usually, the web material will be deformed beyond its elastic limit, although this is not believed to be essential. Nevertheless, deformation beyond the elastic limit results in the closure being substantially stress-free in the finished package, and consequently not applying stress to the container itself, which could otherwise cause damage to the container when weakened during a heat-sterilisation process.

Figure 7:
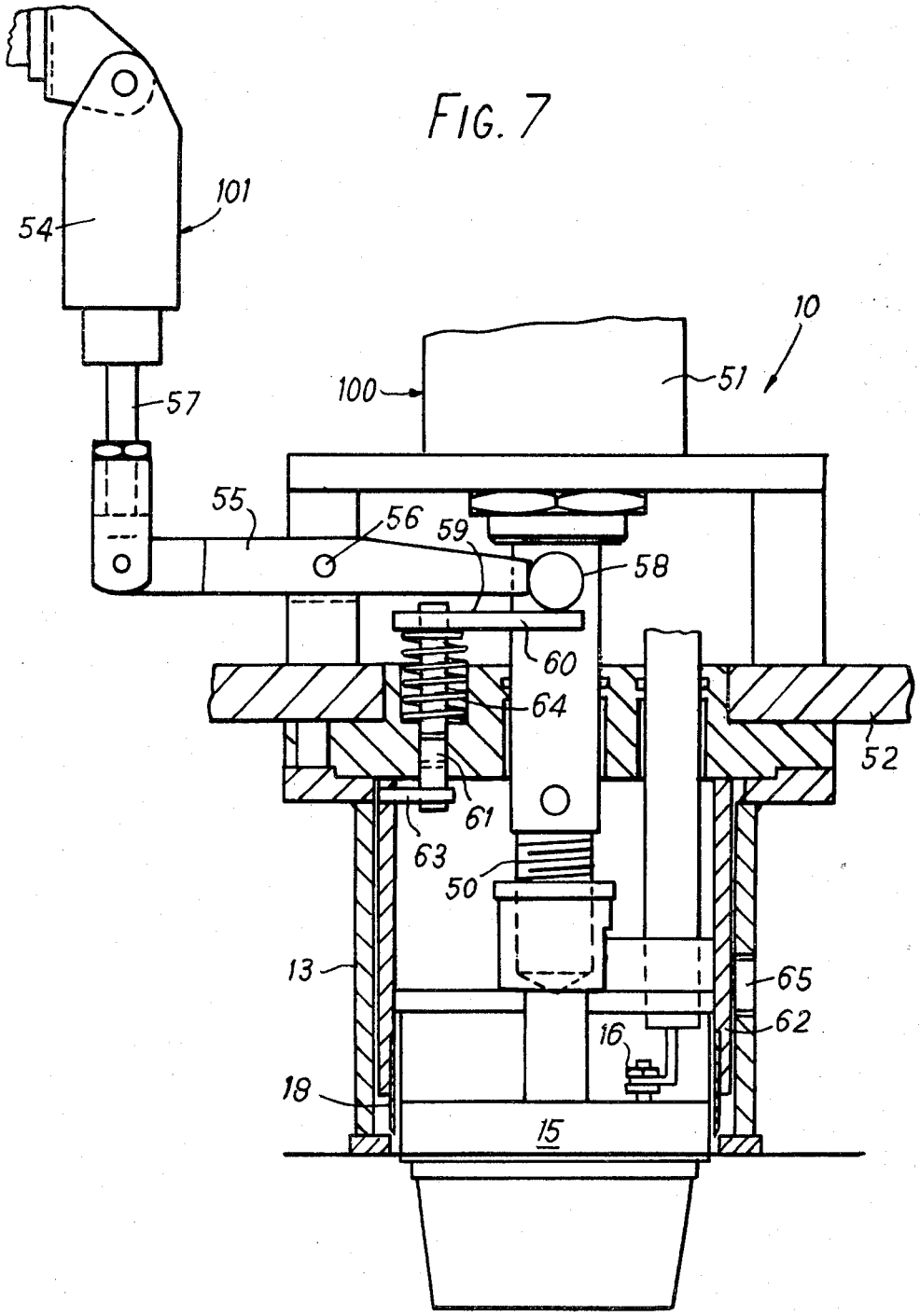
Figure 8:
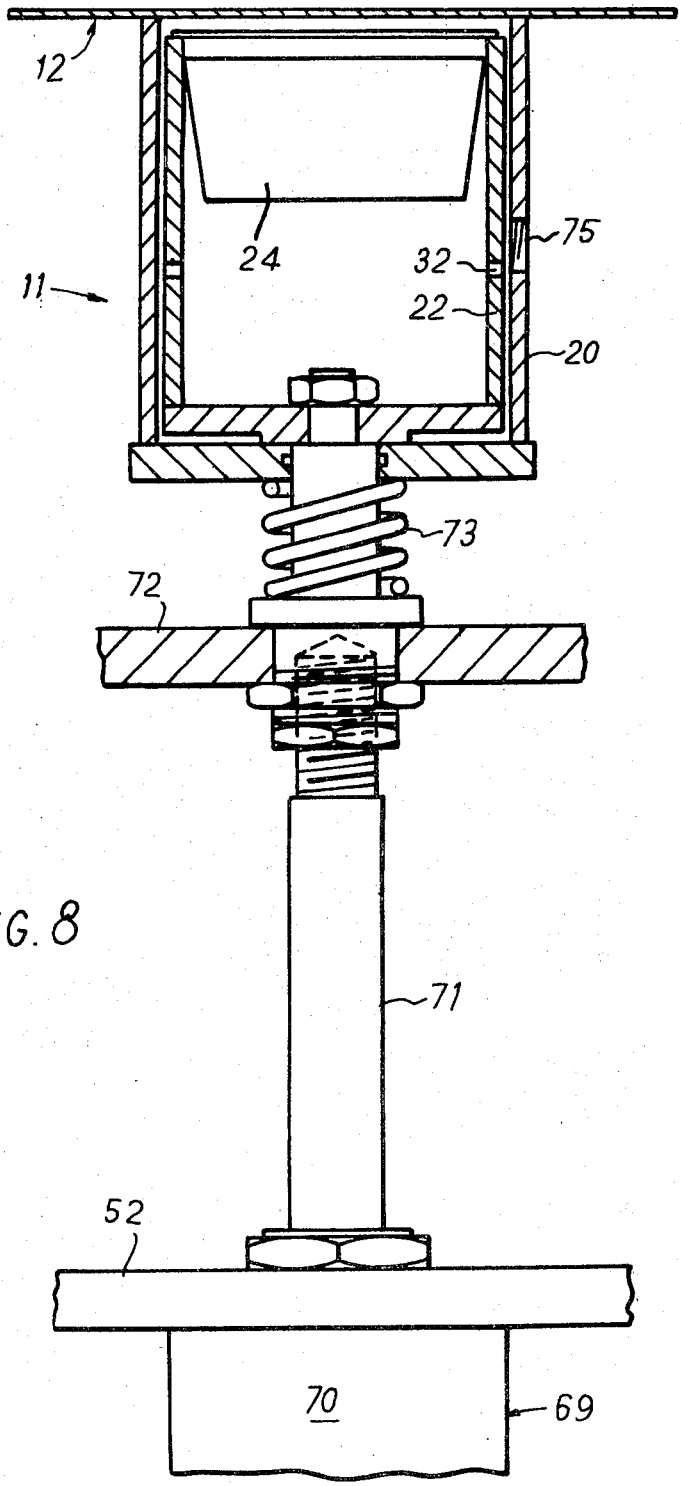

FIGS. 7 and 8 separately and respectively show the upper and lower assemblies of an apparatus adapted and arranged to perform the sequence of operations described above with reference to FIGS. 1 to 6. The assemblies are separately shown in relation to a web 12 and tub 24 to be closed, but it is to be understood that that the web and tub are common to the two assemblies. The upper assembly (FIG. 7) is shown in its condition during heat-sealing, whereas the lower assembly (FIG. 8) is shown when the vacuum is being drawn in the lower clamping member 20. Thus, FIG. 7 corresponds to FIG. 3, whereas FIG. 8 corresponds to FIG. 2. The same reference numerals are used in FIGS. 7 and 8 as in FIGS. 1 to 6 to denote like or analogous parts.

Referring firstly to FIG. 7, the upper assembly 10 has its heat sealing pad 15 arranged to be axially moved within the upper clamping member 13 by the operating rod 50 of a pneumatic actuator 100. The cylinder 51 of this actuator is mounted on the machine frame 52, which also mounts the clamping member 13. Only one terminal (16) of the heat sealing pad 15 is visible.

For operating the knife 18 the assembly 10 has a further pneumatic actuator 101 with its cylinder 54 attached to the machine frame. A lever 55, centrally pivoted at 56, is connected to the operating rod 57 of this actuator at one end. The other end of the lever is bifurcated, its two arms straddling the operating rod 50 of the actuator 100 for the heat sealing pad, and individually terminating in discs 58 arranged to make rolling contact with the upper surface 59 of a horizontally supported plate 60.

The plate 60 is triangular. At its three apices it mounts the upper ends of vertical studs 61 one of which only is visible. The studs extend downwardly from the plate 60 to the level of the top end of a vertical cylinder 62 lying concentrically within the clamping member 13. The cylinder 62 carries the knife 18 at its bottom end; its top end is connected to the lower ends of the studs 61 by horizontal pins 63.

The plate 60, studs 61, pins 63, cylinder 62 and knife 18 are biassed upwardly as one to the limiting position shown in FIG. 7; this limiting position corresponds to the retracted position of the knife as previously mentioned. The biassing is achieved by three compression springs 64 which are individually sleeved over the studs 61 so as to bias the plate 60 upwardly in relation to the machine frame.

It will readily be appreciated from the foregoing description that movement of the heat sealing pad 15 towards and away from the web is effected by the actuator 100, whereas movement of the knife 18 is effected by the actuator 101 operating via rolling contact between the discs 58 and the plate 60. These movements are independent of one another and suitably controlled.

The clamping member 13 has a screw-threaded hole 65 to receive a conduit 30 (FIGS. 1 to 6) for controlling its internal pressure.

The lower assembly 11 (FIG. 8) has a pneumatic actuator 69 with its cylinder 70 mounted on the machine frame 52 and having its operating rod 71 bolted to the support member 22. Part way along its length the operating rod is fixed to a guide member 72 having its ends (not shown) guided for vertical movement so as to restrain the operating rod against lateral deflection.

The actuator 69 serves to operate the lower clamping member 20 as well as the support member 22. To that end a compression spring 73 biasses the clamping member upwardly (towards the web 12) in relation to the support member, and the actuator 69 can be controlled to provide a low output force or a high output force as required.

The low output force is used when the lower assembly 11 is raided to clamp the web between the clamping members 13,20 as previously described. It is insufficient to compress the spring 73 to raise the support member to its operating position.

The high output force is capable of compressing the spring 73 as required for heat-sealing, deformation and web severance, and it will therefore be appreciated that the actuator 69 is used in its low output mode initially and is changed to its high output mode for the operations of FIGS. 3 to 6.

The clamping member 20 has a screw-threaded hole 75 to receive a conduit 31 (FIGS. 1 to 6) for controlling its internal pressure. Ports 32 are provided in the support member 32 to communicate this pressure to the environment of the tub 24 to be closed.

In the method and apparatus particularly described above, each diaphragm 26 is formed from a parent sheet which is presented to a container body 24 and from which the diaphragm is severed after heat-sealing and deformation; however, a variation of the described arrangement uses preformed diaphragms which are individually presented to the container bodies by suitable means.

In a modification of the described apparatus and method, the heat seal is made approximately at the same time as the deformation occurs; any tendency for the web material to move inwardly across the flange 25 before the heat seal is made is prevented by the frictional resistance generated on the web by the clamping engagement between the heat sealing pad 15 and the support member 22, and between the clamping face 14 and the clamping face 21. The sealing pad is of the kind which is intermittently energised, and energisation is delayed until after the pad and the support member have come into engagement.

The invention is not limited to the use of closures of the kind which are particularly described with reference to the drawings, that is to say, in the form of diaphragms of a relatively flexible material which are heat-sealed to the container bodies.

In many applications of the invention the closure material is of such tensile strength that it is not capable of being stretched to the required degree by atmospheric pressure alone; it is for this reason that the super-atmospheric pressure of the described embodiment is used. However, where circumstances permit, atmospheric pressure alone may be used. If desired, the closure material may be heated to reduce its tensile strength and so assist the stretching operation.

Although the deformation of the closure in the described embodiment is effected by differential pressure alone, it may be desirable or necessary in some applications additionally or alternatively to use mechanical means to deform the closure, at least for a part of the deformation. Thus a "plug assist" method of deformation may be used, or alternatively a membrane of an elastomeric material may be urged by fluid pressure against the closure. The differential pressure will usually be provided by a gas (e.g. air), but liquid pressure may be used in some applications.

In the described embodiment the attachment of the closure and the complete sealing of the container are achieved in the same operation. However, this is not essential, and in some applications the closure may be attached to the container so as not to seal the container completely closed, the complete closing of the container being achieved at a later stage in the process, for example, after the deformation of the closure into the container headspace.

The deformation of the closure may be carried out in any desired time relation to the attachment of the closure to the container body and the closing of the container, provided that the closure material is prevented from undergoing generally radially inward movement across the container rim when the deformation forces are applied. In arrangements wherein the closure is attached to the container body before the deformation is carried out, it may in some applications be sufficient to rely upon the attachment to prevent such inward movement; indeed, the deformation may be carried out subsequent to attachment, closing and (if necessary) severance, as a post-operation in a separate apparatus. Usually, and as in the described embodiment, at least some of the restraint against inward movement provided for the closure will be generated by clamping the closure against the container body and/or by holding it around the outside of the container body.

The deformation is preferably achieved when a largely reduced gas pressure exists in the container headspace, although this is not essential; for example, the closure may be used to expel any gas from the headspace as it is deformed into the latter.

The invention is not limited to the closure of plastics tubs or pots as particularly described, but has wide application to the closing of rigid or semi-rigid container bodies whether of glass, plastics, metal or otherwise. Although not limited to such applications, the invention is of particular value for oxygen-sensitive products and for the packaging of products which require heat sterilisation after filling and closing. It enables the container body to be filled to a level short of its brim to minimise difficulties with contamination of the area at which the sealing by the closure is to occur, and yet results in a finished container which is mechanically robust (as previously mentioned) and which has little or no remanent gas to cause spoilage of oxygen-sensitive products or to necessitate accurately controlled retorting during heat-sterilisation.

We claim:

1. A method of producing a package of a product, which product does not include a significant amount of gas, comprising the steps of taking a shape retaining container made of a material which is softened at the temperature employed in heat-sterilization and which has a charging opening, charging the container with the product to a level which leaves a headspace, substantially eliminating permanent gas from the headspace, sealing the opening with a closure, and deforming the closure inwardly onto the product to reduce the headspace and continuing the deformation, to move product adjacent the closure into the remaining headspace, until the headspace is eliminated by the continued movement of product and closure, wherein:

(a) the sealing step is achieved by heat-sealing the closure around the opening, (b) the closure is located against the sealing area of the container body before the headspace is eliminated, (c) the closure is of stretchable material and in the deformation step is stretched beyond its elastic limit so as not to tend to return to its original form, (d) the product charge is sufficiently liquid or mobile not to tend to assume any specific natural shape,
(e) the sealed package is heat sterilized, resulting in softening of the container material, and
(f) during heat sterilization an external pressure is maintained at least sufficient to prevent development of vapour in the package, whereby a sterilized package is produced in which the integrity of the seal is preserved and, despite said softening, the container has the same shape as it had prior to heat sterilization.

2. A method as claimed in claim 1, wherein an internal corner is formed at the seal and the deformation of the closure forces product to completely fill the internal corner.

3. A method as claimed in claim 1, wherein, around the periphery of the charging opening, the material of the closure curves smoothly from the periphery of the charging opening into the charging opening.

4. A method as claimed in claim 1, wherein the container is of thermoplastics material.

5. A method as claimed in claim 1, wherein the closure is deformed by the application of super-atmospheric fluid pressure to its outer surface.

6. A method as claimed in claim 1, wherein deformation of the closure is at least assisted by the application of mechanical force to its outer surface.

7. A method as claimed in claim 1, wherein the deformation of the closure is effected after the opening has been sealed by the closure, the sealing of the opening being itself effected at a time when the headspace associated with the opening is subject to a largely reduced gas pressure.

8. A method as claimed in claim 1, wherein the deformation of the closure is effected before the closure is heat-sealed around the opening.

9. A method as claimed in claim 8, wherein the deformation of the closure is effected at a time when the container is located within a largely reduced gas pressure environment.

10. A method as claimed in claim 1, wherein the closure is heat-sealed to the container at a heat seal region of the closure.

11. A method as claimed in claim 10, wherein the closure is a diaphragm of stretchable and relatively flexible sheet material.

12. A method as claimed in claim 11, wherein the diaphragm is formed from within a sheet of the said stretchable and relatively flexible sheet material which is presented to the container body, the method including the further step of severing the diaphragm from the parent sheet material around the heat seal region after heat-sealing and/or deformation.

13. A method as claimed in claim 10, wherein at least during the time that it is being deformed the diaphragm is clamped at a clamping region surrounding the heat seal region.

14. A method as claimed in claim 10, wherein the closure is of metal foil coated with a heat-sealable thermoplastics material.

15. A method as claimed in claim 14, wherein the container is of a thermoplastics material to which the thermoplastics coating of the diaphragm is directly heat-sealable.

16. A heat sterilized package of a product, comprising a shape retaining container made of a material which is softened at the temperatures employed in heat-sterilization, and charged with a product which does not include a significant amount of gas, the container having a charging opening which is completely sealed by a closure of stretchable material which is substantially totally stretched beyond its elastic limit inwardly into the charging opening, the package interior having no headspace and the package being substantially gas free and substantially hydraulically solid, and in which the package has been heat sterilized while the product is contained therein, the container is undeformed by said heat sterilization, an internal corner at the seal, which corner is completely filled with the product, and around the charging opening the material of the closure curves smoothly from the periphery of the charging opening into the charging opening.

17. A package of a product comprising a shape-retaining container made of a material which is softened at the temperatures employed in heat-sterilization, and charged with a product which does not include a significant amount of gas, the container having a charging opening which is completely sealed by a closure of stretchable material which is deformed inwardly into the charging opening, the package interior having no headspace and the package being substantially gas free and substantially hydraulically solid, and in which the package has been heat sterilized and the container is undeformed, an internal corner at the seal which corner is completely filled with the product, and around the charging opening the material of the closure curves smoothly from the periphery of the charging opening into the charging opening.

18. A package as claimed in claim 17, wherein the closure is substantially stress free.

19. A package as claimed in claim 17, wherein the closure is heat-sealed to the container.

20. A package as claimed in claim 17, wherein the closure is a diaphragm of stretchable and relatively flexible sheet material.

21. A package as claimed in claim 17, wherein the closure is of metal foil coated with a heat-sealable synthetic polymeric thermoplastics material.

22. A package as claimed in claim 17, wherein the container is of synthetic polymeric thermoplastics material.

23. A package as claimed in claim 21, wherein the container is of a synthetic polymeric thermoplastics material to which the thermoplastics coating of the diaphragm is directly heat-sealable.

24. A package as claimed in claim 17, in which at least that part of the product nearest to the seal is liquid.

25. A method of closing an opening of a shape-retaining container containing only sufficient product to leave a substantial headspace, comprising, in the following sequence, evacuating the headspace, completely sealing the opening with a closure of a sheet material which is permanently stretchable into the opening, so as to close the headspace while it is still evacuated, and applying to the outside of the closure a gas pressure substantially greater than atmospheric pressure to permanently stretch the closure inwardly into intimate contact with the product over the whole plan area of said opening.

26. Apparatus for producing a package of a product which is substantially devoid of headspace and does not include a significant amount of gas, the package being formed from a container made of a material which is softened at temperatures employed in heat-sterilization and a closure formed from stretchable material spanning a mouth of the container comprising means for supporting the container with a product therein below stretchable closure material, means for reducing pressure within the container, means for heat sealing a peripheral edge of the container to an overlying portion of the stretchable material after the container pressure has been reduced thereby forming a peripheral heat seal, means for increasing pressure exteriorly of the stretchable material after the formation of the peripheral heat seal to permanently deform the stretchable material bounded by the peripheral heat seal into the container to essentially eliminate the headspace therein, means for enclosing the container and surrounding the stretchable material above and below the latter outboard of the peripheral heat seal, said enclosing means being a pair of housings, said pair of housings being disposed in superposed aligned relationship, said housings having cooperative means for clamping the stretchable material therebetween outboard of the peripheral heat seal, said cooperative clamping means being defined by opposed aligned peripheral edges of said pair of housings, said heat sealing means and container supporting means being housed in different ones of said housings and at opposite sides of the stretchable closure material, said pressure reducing means being operative after the stretchable material has been clamped by said aligned housing peripheral edges, said pressure reducing means is in fluid communication with a lowermost of said pair of housings, and knife means for severing said package outboard of the peripheral heat seal prior to the removal of the package from the enclosing means.

27. The apparatus as defined in claim 26 including means for moving said heat sealing means relative to its housing to form the peripheral heat seal.

28. The apparatus as defined in claim 26 including means for moving said heat sealing means relative to its housing to form the peripheral heat seal, the container further including a peripheral flange in supporting relationship upon said container supporting means, and said moving means moves said heat sealing means to effect sandwiched clamping contact of the flange between between said container supporting means and said heat sealing means whereby the peripheral heat seal includes the flange of the container.

29. The apparatus as defined in claim 26 wherein said pressure increasing means is in fluid communication with an uppermost of said pair of housings.

* * * * *